United States Patent [19]

Erickson

[11] Patent Number: 4,471,987

[45] Date of Patent: Sep. 18, 1984

[54] BOTTLE CARRIER

[76] Inventor: Gerald Erickson, 201 Via Linda, Palm Beach, Fla. 33480

[21] Appl. No.: 438,364

[22] Filed: Oct. 25, 1982

[51] Int. Cl.[3] ..... B65D 71/00

[52] U.S. Cl. ..... 294/87.2; 206/145; 206/150

[58] Field of Search ..... 294/87 R, 87.2, 87.28; D9/344; 206/139, 141, 142, 145, 147, 150, 153, 161, 167, 168, 199, 201, 427

[56] References Cited

U.S. PATENT DOCUMENTS 3,232,422 2/1966 Whyte ..... 294/87.2 X 3,442,547 5/1969 Skillen ..... 294/87.2

4,235,468 11/1980 Erickson ..... 294/87.2

*Primary Examiner*—Johnny D. Cherry

*Attorney, Agent, or Firm*—Brumbaugh, Graves, Donohue & Raymond; Brumbaugh, Graves, Donohue & Raymond

[57] ABSTRACT

An integrally formed injection molded bottle carrier having protective bridge bars extending between spaced-apart points of the frame and above and across the upper end of each bottle to protect and prevent removal of the caps of the bottles without concealing the caps from inspection.

3 Claims, 4 Drawing Figures

BOTTLE CARRIER

This invention relates to an integrally formed bottle carrier for supporting a plurality of bottles and, more particularly, to a bottle carrier of that type having protective means to prevent damage to or tampering with the bottle caps or closures without concealing them from inspection.

The bottle carrier of the present invention is an improvement over the bottle carriers which are the subjects of my U.S. Pat. No. 3,633,962, granted Jan. 11, 1972, and U.S. Pat. No. 4,235,468, granted Nov. 25, 1980. The bottle carrier of the earlier patent embodies a relatively rigid frame for supporting a plurality of bottles in spaced-apart relationship within the confines of the frame in such a manner that the caps or closures are exposed to view. The bottle carrier of the later patent has a bottle retaining loop bar supported from the frame by a plurality of depending supports so that the loop bar will surround the cluster of bottles without concealing the bottles.

These bottle carriers are attractive, inconspicuous, rugged and reuseable, and they provide an economical and effective package which does not conceal the bottles from inspection. The bottle caps, however, protrude above the frame and can be damaged, twisted or removed, accidentally or deliberately, to mar or dent the cap or to break the seals. Moreover, when the packages are stacked, the lower ends of the bottles of the upper package are supported directly on the bottle caps of the lower package so that the caps can be damaged, dented or marred and possibly loosened.

The present invention overcomes these problems by providing a bottle cap protector integrally formed with the carrier above each of the bottle engaging means supported within the frame. The bottle cap protectors are formed of one or more bars which bridge the bottle engaging means and extend across the top of the bottle cap, and they are dimensioned and/or spaced so as to protect and prevent twisting of the bottle cap without concealing its condition from the customer's view. The bottle cap protectors also facilitate stacking of packages of bottles, providing a resilient support between the bottles of the upper package and the caps of the lower package, while preventing damage to the bottles of the upper package or the bottle caps of the lower package.

These and other advantages and features of the present invention will be apparent from the detailed description which follows and from the accompanying drawings in which.

Figure 1:
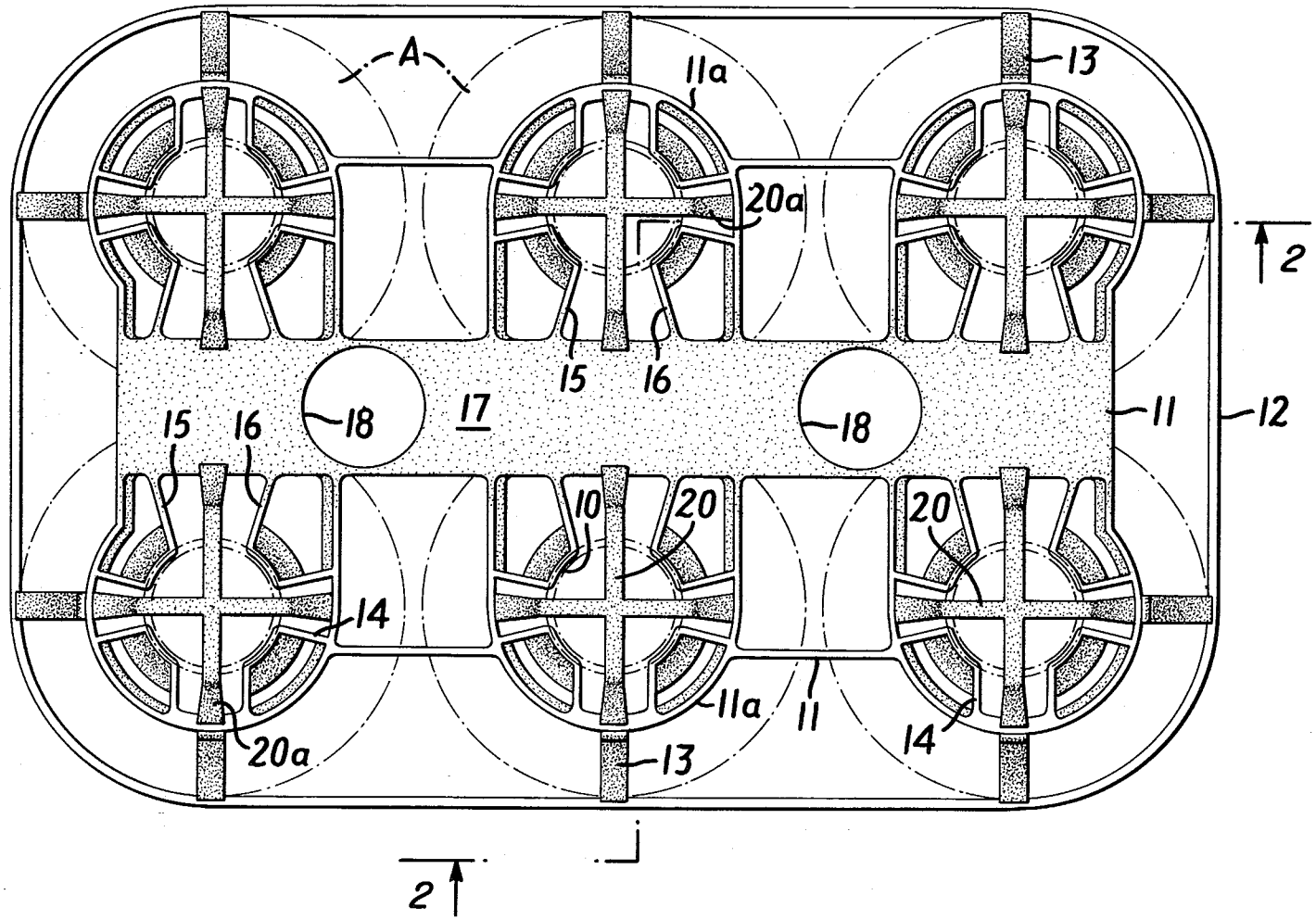
FIG. 1 is a plan view of a bottle carrier embodying the present invention.
Figure 2:
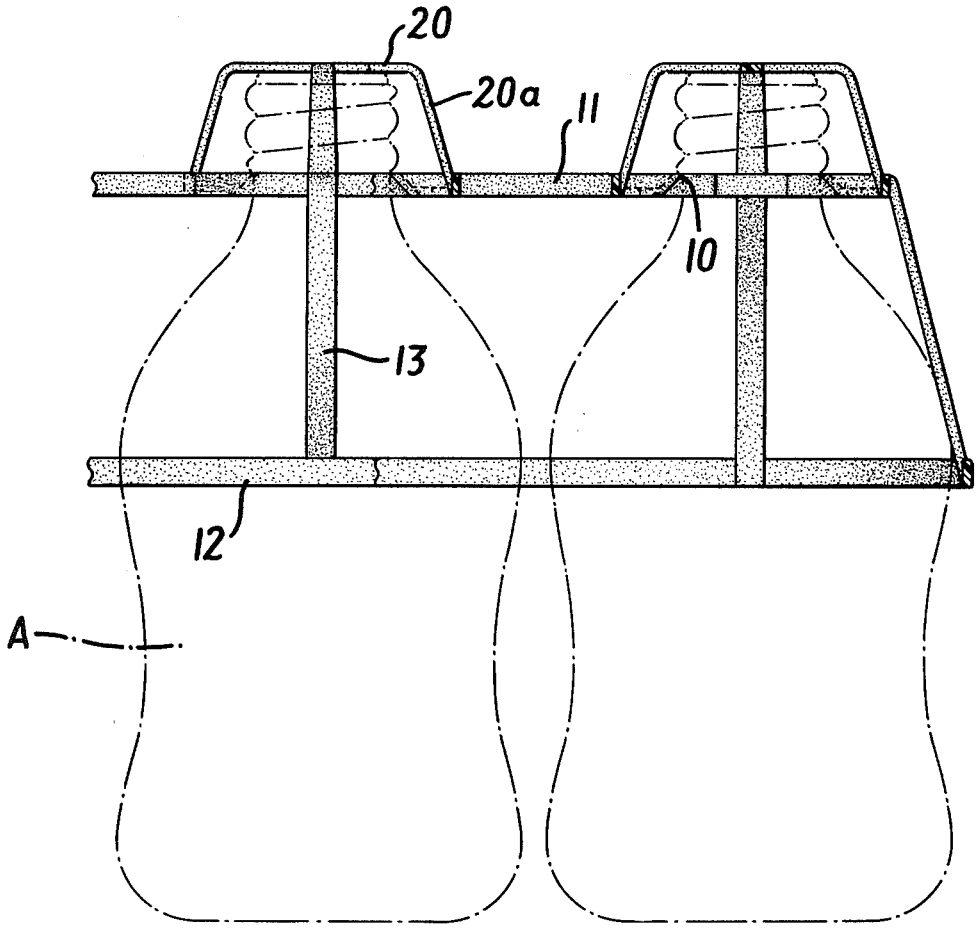
FIG. 2 is a sectional view taken along the line 2—2 of FIG. 1 looking in the direction of the arrows.

A bottle carrier embodying the present invention, shown in FIGS. 1 and 2, includes a plurality of bottle neck engaging means in the form of collar segments 10 for receiving and supporting therein the necks of bottles A to be packaged, a frame 11 for supporting the collars in spaced relation, a bottle retaining loop bar 12 beneath the frame and formed in a closed loop surrounding the bottles to be packaged, and relatively rigid diagonal supports 13 depending from the frame to support the loop bar in spaced-apart relation below the frame. The carrier can be applied to clusters of bottles to be packaged manually or by automated machinery. When the carrier is applied to the bottles, the loop bar is automatically positioned to surround the bottles through the depending supports which retain it. The bottles so packaged are visible for inspection of the labels and the condition of the bottles and their caps.

The bottle engaging collars and the frame are generally similar to the six-bottle carrier disclosed in my U.S. Pat. No. 3,633,962. The frame is sub-divided into a plurality of individual frames 11*a*, each containing the bottle engaging collar segments 10. The collar segments of each individual frame are preferably spaced so that the distance between centers is substantially the width or diameter of the bottle to be carried.

The bottle engaging segments are tapered so as to be larger at the bottom than at the top to facilitate the insertion of the bottle necks therein from the bottom. The collar segments 10 are connected by legs 14 to the respective individual frames 11*a*. The inner collar segments are connected to the frame by a pair of longer, diagonally extending legs 15 and 16 which define between them an expandable opening for removal of a bottle while at the same time providing support for the collar segments to prevent them from sagging under the weight of the bottle and to offer resistance to accidental spreading of the legs 15 and 16 when a bottle is supported within the collar segments.

The frame 11 includes a longitudinally extending bar 17 which, in the six-bottle carrier shown in the drawings, extends substantially the length of the larger dimension of the frame. The bar 17 includes a pair of finger openings 18 therein to facilitate handling.

When the bottles are packaged in the carrier, the bottle caps are not only exposed to view, but they are accessible so that the caps can be accidentally or intentionally damaged, twisted or even removed. In this connection, the packaged bottles are often stacked, scratching or denting the caps of the underneath bottles, and sometimes even damaging the bottles themselves.

To overcome these problems, the carrier of the present invention has protective bridge bars 20 integrally formed with the frame above the upper end of each bottle to protect and prevent twisting or removal of the caps of the bottles without concealing the caps from inspection as to their condition. Each protective bridge bar is of generally inverted U-shaped configuration having a pair of legs 20*a* extending upwardly from spaced-apart points of the frame and a bridge across the top of the bottle to limit access to the cap and to provide a resilient support for stacking packages of the bottles.

A single protective bridge bar can be provided across each bottle, but preferably two or more are used to prevent the caps from being unscrewed or removed. As shown in the drawings, a pair of crossed bridge bars having a pair of upstanding legs and crossed flat bridges connecting the upper ends of opposite legs and integrally connected at the intersection thereof not only afford excellent protection to the bottle without concealing the caps from inspection, but they provide flat resilient supports which facilitate stacking without damage to the bottles.

Figure 3:
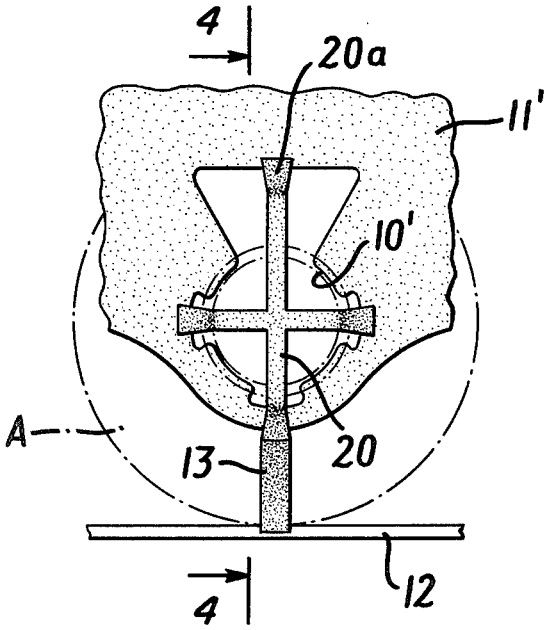
FIG. 3 is a plan view of a modified version of the bottle carrier of the present invention.
Figure 4:
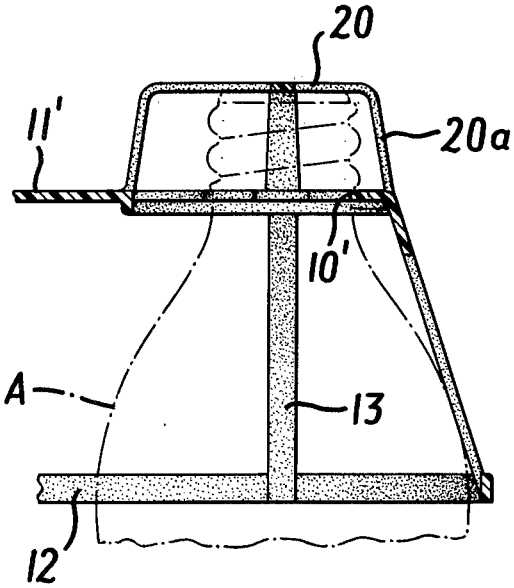
FIG. 4 is a sectional view taken along the line 4—4 of FIG. 3 in the direction of the arrows.

An alternative embodiment of the invention is shown in FIGS. 3 and 4 in which the bottle engaging collar segments 10' are formed as part of the frame 11' and the crossed protective bridge bars 20' are formed integrally with the frame.

The bottle carrier of the present invention is preferably injection molded in one piece of a resilient plastic material, such as injection molded polypropylene. It provides an effective, economical and convenient package for carrying a cluster of bottles in relatively close and controlled fashion. Since the bottles can be inserted and withdrawn without destroying the carrier, the carrier can be used for handling full, partially full and empty bottles and used not only for carrying home a cluster of newly purchased bottles but also for returning the empty bottles.

The invention has been shown in preferred forms and by way of example only, and many modifications and variations may be made therein without departing from the spirit of the invention. The invention, therefore, is not to be limited to any specified form or embodiment, except in so far as such limitations are expressly set forth in the claims.

I claim:

1. An integrally formed injection molded bottle carrier in which a plurality of bottles can be carried in a close cluster, comprising a plurality of bottle neck engaging means for receiving and supporting therein the necks of the bottles with the bottle caps exposed to view, a relatively rigid frame for supporting the neck engaging means in spaced-apart relation to each other within the confines of the frame to insure that the bottles are closely clustered together and relatively rigid, nonstretchable bars integrally formed at their lower ends at spaced-apart points with the frame adjacent the upper end of each bottle neck engaging means and extending upwardly from the frame forming bridges across the upper end of each bottle neck engaging means to protect and prevent removal of the caps of the bottles without concealing the caps from inspection.

2. A bottle carrier as set forth in claim 1 including a loop bar spaced below the frame and surrounding the cluster of bottles and relatively rigid diagonal supports depending from the frame for retaining the loop bar in spaced-apart relation to the frame.

3. A bottle carrier as set forth in claims 1 or 2 in which the spaced apart bars are flat and integrally formed at their upper ends to provide a flat resilient support for stacking packages of the bottles.

* * * * *